US010766728B2

(12) United States Patent
Kummel et al.

(10) Patent No.: US 10,766,728 B2
(45) Date of Patent: Sep. 8, 2020

(54) APPARATUS AND METHOD FOR SPLICING SUBSTANTIALLY FLAT CONTINUOUS MATERIAL

(71) Applicant: PHILIP MORRIS PRODUCTS S.A., Neuchatel (CH)

(72) Inventors: Matthieu Kummel, Ivry sur Seine (FR); Sebastien Fontaine, Courcourrones (FR)

(73) Assignee: Philip Morris Products S.A., Neuchatel (CH)

( * ) Notice: Subject to any disclaimer, the term of this patent is extended or adjusted under 35 U.S.C. 154(b) by 137 days.

(21) Appl. No.: 15/503,860

(22) PCT Filed: Oct. 13, 2015

(86) PCT No.: PCT/EP2015/073628
§ 371 (c)(1),
(2) Date: Feb. 14, 2017

(87) PCT Pub. No.: WO2016/059022
PCT Pub. Date: Apr. 21, 2016

(65) Prior Publication Data

US 2017/0233210 A1 Aug. 17, 2017

(30) Foreign Application Priority Data

Oct. 14, 2014 (EP) ..... 14188864

(51) Int. Cl.
*B65H 21/00* (2006.01)
*B65H 19/18* (2006.01)

(52) U.S. Cl.
CPC ..... *B65H 21/00* (2013.01); *B65H 19/18* (2013.01); *B65H 19/1852* (2013.01);
(Continued)

(58) Field of Classification Search
CPC ..... B65H 21/00; B65H 11/005; B65H 18/22; B65H 2801/54; B65H 2301/46115;
(Continued)

(56) References Cited

U.S. PATENT DOCUMENTS 3,089,661 A 5/1963 Phillips, Jr.
3,586,006 A 6/1971 Wendt
(Continued)

FOREIGN PATENT DOCUMENTS

DE 1069644 11/1959
DE 102012107215 A1 * 2/2014 ..... B29D 30/42
(Continued)

OTHER PUBLICATIONS

Machine Translation of DE102012107215A1.*
(Continued)

*Primary Examiner* — Christopher M Koehler
*Assistant Examiner* — Kyle A Cook
(74) *Attorney, Agent, or Firm* — Mueting Raasch Group

(57) ABSTRACT

The apparatus and method for splicing substantially flat continuous material (10) comprises a transport unit (1) for transporting a first substantially flat continuous material (70) and a second substantially flat continuous material (71) to a splicing location. The transport unit is adapted to transport the first substantially flat continuous material and the second substantially flat continuous material parallel to each other forming an overlap portion of the first substantially flat continuous material and the second substantially flat continuous material in the splicing location. A pressure unit (3) is arranged in the splicing location. The pressure unit is adapted to apply a mechanical impact onto at least a part of the overlap portion of the first substantially flat continuous material and the second substantially flat continuous material, thereby at least partially merging the first substantially
(Continued)

flat continuous material with the second substantially flat continuous material.

14 Claims, 2 Drawing Sheets

(52) U.S. Cl.
CPC ..... *B65H 2301/463* (2013.01); *B65H 2301/4621* (2013.01); *B65H 2301/4625* (2013.01); *B65H 2301/4632* (2013.01); *B65H 2301/4634* (2013.01); *B65H 2301/46115* (2013.01); *B65H 2301/5126* (2013.01); *B65H 2301/5142* (2013.01); *B65H 2301/51432* (2013.01); *B65H 2801/54* (2013.01)

(58) Field of Classification Search
CPC ..... B65H 2406/321; B65H 2404/233; B65H 19/1842; B65H 19/1852; B65H 2301/46412
See application file for complete search history.

(56) References Cited

U.S. PATENT DOCUMENTS 4,059,120 A * 11/1977 Molins ..... A24C 5/34 131/904
5,018,535 A 5/1991 Da Silva
5,514,237 A * 5/1996 Emenaker ..... B29C 65/18 156/157
5,667,124 A * 9/1997 Bannenberg ..... B65H 23/24 242/615.11
5,827,166 A 10/1998 Cestonaro
6,244,321 B1 * 6/2001 Sakamoto ..... B65H 19/1852 156/159
2012/0100978 A1 * 4/2012 Tommasi ..... B65H 19/1836 493/227
2016/0286852 A1 * 10/2016 Gindrat ..... B65H 19/1852

FOREIGN PATENT DOCUMENTS

EP 0 622 318 11/1994
GB 1150322 A * 4/1969 ..... A24C 5/20
GB 1390506 A * 4/1975 ..... B65H 23/1825
JP 2003-206059 1/2002
JP 05-051853 2/2005
JP 2006-115775 5/2006
JP 2007-137896 6/2007
JP 2008-081274 4/2008
JP 2012-076853 4/2012
JP 2012-153134 8/2012
WO WO 91/16256 10/1991

OTHER PUBLICATIONS

PCT Search Report and Written Opinion for PCT/EP2015/073628 dated Jan. 6, 2016 (14 pages).
International Preliminary Report on Patentability for PCT/EP2015/073628 dated Oct. 14, 2016 (17 pages).

* cited by examiner

APPARATUS AND METHOD FOR SPLICING SUBSTANTIALLY FLAT CONTINUOUS MATERIAL

This application is a U.S. National Stage Application of International Application No. PCT/EP2015/073628, filed Oct. 13, 2015, which was published in English on Apr. 21, 2016 as International Publication No. WO 2016/059022 A1. International Application No. PCT/EP2015/073628 claims priority to European Application No. 14188864.4 filed Oct. 14, 2014.

The invention relates to an apparatus and method for splicing substantially flat continuous material. Especially, it relates to an apparatus and method for splicing substantially flat continuous material used in the manufacture of smoking articles.

In aerosol generating articles or their components such as for example, filter plugs or tobacco plugs may be manufactured at least partially from a substantially flat continuous material, such as a paper, tobacco or plastic web. Due to the special materials used for the production of these plugs, some processing steps in a processing line do not allow for conventional joining methods for two subsequent webs. For example, joining material such as glue may influence the taste of the final product. Taping or stapling is not effective or adds further material to the webs that may lead to machine blockage, for example within a funneling or crimping process of the joined webs.

Thus there is a need for an apparatus and method for splicing substantially flat continuous material. Especially, there is a need for an apparatus and method for splicing substantially flat continuous material, which substantially flat continuous material may be used in the production of aerosol-generating articles or smoking articles.

According to a first aspect of the present invention, there is provided an apparatus for splicing substantially flat continuous material. The apparatus comprises a transport unit for transporting a first substantially flat continuous material and a second substantially flat continuous material to a splicing location. The transport unit is adapted to transport the first substantially flat continuous material and the second substantially flat continuous material parallel to each other forming an overlap portion of the first substantially flat continuous material and the second substantially flat continuous material in the splicing location. The apparatus further comprises a pressure unit arranged in the splicing location adapted to apply a mechanical impulse onto at least a part of the overlap portion of the first substantially flat continuous material and the second substantially flat continuous material, thereby at least partially merging the first substantially flat continuous material with the second substantially flat continuous material thereby producing a merged substantially flat continuous material. Preferably, some embodiments of the apparatus also comprise a transport control for interrupting a transport of the first substantially flat continuous material and of the second substantially flat continuous material when the overlap portion is in the splicing location. By this, the splicing may be performed while the first and the second continuous material to be merged are stationary. With the transport control the further transport of the first substantially flat continuous material and the second substantially flat continuous material may be initialized, when a merged substantially flat continuous material has been produced. Preferably, such a further transport is controlled by controlling a velocity profile. Preferably, a velocity is gently, preferably constantly raised up to a final transport velocity. By controlling the velocity profile excess pulling on the continuous material may be avoided or kept at a minimum, thus avoiding or reducing the risk of tearing the merged continuous material.

A mechanical impact applied to the substantially flat continuous materials to at least a part of the overlap portion creates a strong connection between the two webs. By the splicing process, the materials are merged into each other and may create a form fit or a chemical connection or a combination of a form fit and a chemical connection. A connection may, for example, be created by a partial or a complete melting of the material in at least parts of the mechanical impact area.

The amount of force applied may be adapted to achieve the merging of the flat materials and may be varied depending on mechanical or physical specifications of the substantially flat continuous materials. According to some embodiments of the apparatus according to the invention, the pressure unit is adapted to apply a mechanical impact with a force in a range between about 100 Newton and about 600 Newton, preferably above 300 Newton, for example 450 Newton. In addition, the pressure applied to the continuous webs depends on the surface area of the pressure unit that gets into contact with the continuous webs. Preferably, the surface area is between about 1 square centimeter and about 200 square centimeters, preferably, between about 2 square centimeters and about 100 square centimeters, more preferably, between about 4 square centimeter and about 50 square centimeters.

A time duration of a mechanical impact may be in a range of a few hundred milliseconds. Preferably, a time duration of a mechanical impact is in a range between about 100 milliseconds and about 500 milliseconds, more preferably in a range between 200 milliseconds and 400 milliseconds, for example 350 milliseconds.

Mechanical impacts in these magnitudes and duration ranges applied to two overlapping flat materials such as sheets have provided stable and firm connections between sheets typically used in the manufacture of smoking articles or aerosol-generating articles. The applied mechanical impact may cause heat. The so produced heat may at least partially melt the substantially flat continuous material and thereby support a splicing process. Heat may also be provided from an external heat source to support the splicing process. In some embodiments of the apparatus according to the invention, the apparatus comprises a heating unit to heat at least a portion of the pressure unit, preferably a hammer edge or portions of the hammer edge the material comes into contact with upon splicing.

The forces in the mentioned power range may especially be applied without breaking the webs upon splicing. However, it becomes apparent to a person skilled in the art that a minimum or maximum mechanical impact applied may be dependent on the substantially flat continuous material to be spliced and may thus be adapted to, for example, a thickness or a hardness of the substantially flat continuous material.

The pressure unit may for example be realized as a hammer hammering against an anvil arranged opposite the hammer on the other side of the web of substantially flat continuous material. The pressure unit acts upon the overlapping substantially flat continuous material, while the substantially flat continuous material is preferably stationary in the splicing location for at least the merging step. With the substantially flat continuous material being stationary and preferably also a stationary pressure unit (stationary in view of a moving direction of the substantially flat continuous material), advantageously shear forces can be avoided during the splicing process. This is advantageous as otherwise shear forces may displace or damage the substantially flat continuous material, in particular when the material is pulled into a transport direction during the splicing operation.

An overlap portion as used herein is a portion of flat material where an end portion of a preceding first substantially flat continuous material and a head portion of a subsequent second substantially flat continuous material overlap, that is, lie on top of each other or also in an overlapping manner next to each other (depending on the orientation of the web material in the apparatus). Therein, the end portion and head portion of the continuous material are seen in a longitudinal direction corresponding to the transport direction of the materials. Preferably, the two continuous materials to be spliced have the same width. Preferably, the two continuous materials are aligned with respect to their longitudinal middle axis. In that preferred embodiment, the overlap portion has the same width as the width of the individual materials. The longitudinal extension of the overlap portion is predetermined to guarantee a reliable splicing of the materials. Preferably, the longitudinal extension of the overlap portion is adapted to a material to be spliced and a mechanical impact performing the merging of the materials. Preferably, a longitudinal extension of the overlap portion is kept small. The longitudinal extension of the overlap portion may for example be about at least 2.5 times larger than a width of a hammer edge (wherein the width of the hammer edge extends in transport direction of the material) acting on the material upon the mechanical impact. By this, waste may be kept at a minimum if the overlap portion is subsequently removed from the product.

In the apparatus according to the invention a first substantially flat continuous material is, for example, used in the production of an endless rod of crimped or gathered or of crimped and gathered substantially flat continuous material. If the substantially flat continuous material or a bobbin the substantially flat continuous material is wound onto, respectively, comes to an end, a second substantially flat continuous material may be supplied to the apparatus. This second substantially flat continuous material is then transported by the transport unit to overlap with the first substantially flat continuous material and is transported to the splicing location. After merging the two substantially flat continuous materials, the production of the endless rod of substantially flat continuous material may continue with the now merged substantially flat continuous material and preferably without interruption and at a same speed.

With the apparatus according to the invention, a strong connection may be provided with no additives or additional material that might influence taste of an aerosol generator the material is used in. The applied mechanical impact to the substantially flat continuous materials, in at least a part of the overlap portion, provides a merging of the two materials and by this a connection between the two substantially flat continuous materials substantially corresponding to the strength of a single substantially flat continuous material.

In addition, a connection may be provided that has no or only limited effect on processes subsequent to the splicing process in a sheet processing line. Such subsequent processes may for example be a subsequent embossing process or rod forming process. With the apparatus according to the invention, a processing line may be continuously operated at high speed with ongoing constant quality of the product to be manufactured. In addition, any waste material possibly produced may be kept at a minimum.

A substantially flat continuous material as used herein may be a web of material such as paper, tobacco or plastic web or a metal foil that may be used in the manufacture of smoking articles. Preferably, the substantially flat continuous material is a continuous sheet of polylactic acid or a tobacco sheet. The substantially flat continuous material may have been pretreated. A pretreatment may for example be crimping or embossing or both.

According to an aspect of the apparatus according to the invention, the pressure unit comprises a hammer edge, which is arranged transverse to a moving direction of the transport unit. The direction transverse to the moving direction deviates from a direction perpendicular to the moving direction by a splicing angle. The splicing angle may be in a range of between about 10 degree and about 60 degree, preferably between about 15 degree and about 45 degree, for example 40 degree. That is, the hammer edge is not arranged perpendicular to the moving direction but slightly oblique relative to this exact perpendicular direction. Preferably, the hammer edge has an extension spanning over at least part of or an entire width of the substantially flat continuous material to be spliced or of the overlap portion of the substantially flat continuous materials, respectively. However, it is not required that the hammer edge continuously extends over the entire width of the continuous material to guarantee the reliable splicing of the two web materials. For example, a hammer edge may also extend over each of the lateral sides of the continuous material or provide a discontinuous splicing line over the width of the continuous material.

By combining two sheets the material gets thicker where the two sheets overlap. Further, an additional bump or inverse bump may be created by the mechanical impact acting on the overlap portion. A bump may basically function as a speed bump for rollers, for example drive rollers or crimping rollers, the material is guided along. However, irregular guiding of the substantially flat continuous material may damage the material or lead the sheet to be arranged or pulled skew to a transport direction. Irregular crimping may lead to irregular rod formation and thus limit reproducibility of rod specifications. By arranging the hammer edge at an angle to the transport direction and by this applying the mechanical impact at an angle to the moving direction of the substantially flat continuous materials, a downstream roller or roller pair, will not encounter a bump over the entire width of the substantially flat continuous material, or of the roller, respectively, at the same instant. Typically, a roller or roller pair is arranged perpendicular to a transport direction of the substantially flat continuous material. The roller will encounter a bump only at one, possibly several, locations distributed over the width of the roller. For example, the hammer edge may be a linear edge extending over part of or the entire width of the substantially flat continuous material. A splicing line produced by the hammer edge will then extend obliquely across the width of the substantially flat continuous material. Thus, a roller passing the substantially flat continuous material will encounter one end of the slicing line and will subsequently smoothly and continuously be rolling over the splicing line.

A hammer edge may be embodied as a continuous edge. Alternatively, the hammer edge may be embodied as a plurality of edge sections. Preferably, edge sections of such a plurality of hammer edge sections are arranged in a line separated by predefined distances.

A hammer edge may have a substantially rectangular impact surface or a combination of substantially rectangular impact surfaces. Alternatively, the impact surface may have different forms, such as oval or triangular. Preferably, the impact surface has a shape without sharp corners. Preferably, any corner has at least a radius of 0.5 mm. Preferably, a tip of a triangle is arranged in a center of the substantially flat continuous material. By this, two obliquely arranged splicing lines may be produced in the substantially flat continuous material upon combining the two substantially flat continuous materials. A roller will first encounter the tip of the triangle and then continuously be rolling over the two splicing lines.

Preferably, an angle between the transverse direction of the hammer edge and the perpendicular direction is small. This may be done in order to limit a longitudinal extension or length of the merged portion, for example a longitudinal extension of the splicing line. By limiting the length of the merged portion also a length of an overlap portion may be kept small. By this, waste may be kept at a minimum if the overlap portion is removed from the product.

According to a further aspect of the apparatus according to the invention, the transport system comprises a belt conveyor. The substantially flat continuous material may be arranged on the belt conveyor and guided by the belt conveyor to and through a pressure unit and further in the processing line. The belt conveyor may be a vacuum belt, where suction is applied to the belt. Suction is, for example, applied to openings arranged in the belt. Suction may support to hold the substantially flat continuous material against the belt. This may especially be favorable when light materials are used or in order to compensate for gravitational forces acting on the substantially flat continuous material. The second substantially flat continuous material may be transported via a second belt conveyor to the first substantially flat continuous material in the splicing location or upstream of the splicing location. The material of a belt conveyor may be adapted to optimize a transport of substantially flat continuous material. The material of the belt may, for example, be adapted to reduce electrostatic charging of the substantially flat continuous material or sticking of the substantially flat continuous material to the belt conveyor. Belts of belt conveyors may for example be made of or comprise polyurethane.

Preferably, only the two continuous materials to be spliced are arranged between a hammer and an anvil of a pressure unit to optimize a splicing process. However, if transport elements of the transport system, such as for example a conveyor belt, is used for transporting the continuous materials, such a conveyor belt may also be present in a merging zone. That is, the conveyor belt may also be arranged in between a hammer and an anvil. A material for the conveyor belt is chosen to withstand the mechanical impacts accordingly. Due to the continuous transport of the conveyor belt a mechanical impact is applied to different locations of the conveyor belt such that mechanical wear may be kept at a minimum.

A belt conveyor may be arranged outside of at least the part of the overlap portion of the first substantially flat continuous material and the second substantially flat continuous material in the splicing location, in at least which part the pressure unit is adapted to apply a mechanical impact to. The conveyor belt of the transport system may be laterally displaced from a hammer edge such as to be outside of a merging zone. By this, the pressure unit or one or several hammer edges of such a pressure unit do not apply a mechanical impact on the conveyor belt but onto the overlapping continuous materials only. A conveyor belt may, for example, be arranged in between two hammer edges.

According to another aspect of the apparatus according to the invention, the transport system comprises a transport support unit adapted to providing a gas stream. Preferably, the gas stream is directed into the moving direction of the substantially flat continuous material and is used for guiding the first substantially flat continuous material or the second substantially flat continuous material or both substantially flat continuous materials into the moving direction. The gas stream may also be used for cooling the substantially flat continuous material, for example heat sensitive substantially flat continuous material. A gas stream may also have an antistatic effect to prevent or reduce electrostatic charging or to discharge already electrostatically charged substantially flat continuous material. For this, the gas stream may for example comprise water droplets or ionized molecules. Preferably, a gas stream used for cooling is applied during or after the combining step. Therefore, one or several nozzles may be arranged next to the pressure unit or along the transport line.

According to yet another aspect of the apparatus according to the invention, the apparatus further comprises a buffer for storing substantially flat continuous material. Preferably, the buffer is arranged downstream of the splicing location. By providing a buffer, an interruption of the flow of substantially flat continuous material for the splicing process may be compensated. By this, a process downstream of the pressure unit may still be continuously performed and preferably at a substantially constant high speed. With a buffer, also a temporary transport speed increase or decrease, for example due to an interruption downstream of the splicing process, may be compensated.

According to a further aspect of the apparatus according to the invention, the apparatus comprises embossing rollers for embossing the substantially flat continuous material. Preferably, embossing roller sets are provided, where the substantially flat continuous material is guided between two rollers of a roller set. Preferably, two roller sets are provided, wherein one roller set is for providing the substantially flat continuous material with an embossing structure in a substantially longitudinal direction of the substantially flat continuous material and the other roller set is for providing the substantially flat continuous material with an embossing structure substantially perpendicular to the moving direction of the substantially flat continuous material. Thus, the substantially flat continuous material may be provided with a longitudinal, a transverse or a waffled structure. Preferably, embossing rollers are arranged downstream of the splicing location, providing the continuous material with an embossing structure to improve or facilitate a gathering of the web material, for example into a rod-shape.

An embossing may be provided in addition of an already present crimping structure of the continuous material.

Preferably, roller sets with a same structure are provided. Preferably, different roller sets are provided with a same gap in between the rollers. A substance may be applied to the surface of a roller or of rollers to facilitate embossing. For example, water may be applied to facilitate embossing of, for example, tobacco sheets or of substantially flat continuous material tending to be electrostatically charged or tending to be heated up, for example by friction caused by the continuous material passing a roller.

According to another aspect of the invention there is provided a method for merging substantially flat continuous material. The method comprises the steps of providing a first substantially flat continuous material and providing a second substantially flat continuous material and aligning the first substantially flat continuous material and the second substantially flat continuous material in an overlapping manner forming an overlap portion. The method further comprises the step of applying a mechanical impact to the overlap portion. Thereby, the first substantially flat continuous material and the second substantially flat continuous material are merged. Preferably, the method also comprises the step of interrupting a transport of the first substantially flat continuous material and of the second substantially flat continuous material when the overlap portion is in a splicing location such that the continuous materials are stationary when being spliced. Preferably, the method then further comprises the step of continuing the transport of the first substantially flat continuous material and the second substantially flat continuous material after splicing the first substantially flat continuous material and the second substantially flat continuous material.

In some preferred embodiments, the step of applying a mechanical impact to the preferably stationary overlap portion comprises applying the mechanical impact over a width of the overlap portion and onto discrete longitudinal positions of the overlap portion.

In some preferred embodiments, the step of applying a mechanical impact to the preferably stationary overlap portion comprises applying the mechanical impact perpendicular to a plane spanned by the first substantially flat continuous material and the second substantially flat continuous material. A force applied perpendicular to a substantially flat continuous material is a very direct manner of force application and may be kept very local. By this, a length of an overlap portion may be kept small since a merged portion, that is, an area, where the substantially flat continuous material is effectively merged, may be kept small. In addition, a mechanical impact performed perpendicular to the plane of the continuous materials has the advantage to require one degree of freedom only for the movement of the device performing the mechanical impact, for example, a hammer edge. Yet further, with a perpendicular mechanical impact the rotation of the device performing the mechanical impact can be avoided, that would otherwise be required to be coordinated with a stationary or moving continuous material.

Advantageously, the step of applying a mechanical impact is performed outside of a transport path of a transport system, for example outside of the transport path of a conveyor belt in the splicing location. By this, a mechanical impact does not act onto the conveyor belt or any other elements of the transport system but solely onto the materials to be spliced.

The splicing may, for example, be performed by applying the mechanical impact on the two lateral sides of the transport path of the transport system in the splicing location, for example on the two lateral sides of the conveyor belt.

According to a further aspect of the method according to the invention, a length of the overlap portion when seen in a transport direction of the first substantially flat continuous material and the second substantially flat continuous material is in a range between about 15 millimeter and about 100 millimeter, preferably in a range between about 20 millimeter and 80 millimeter, for example 40 millimeter. Preferably, an overlap portion is kept at a minimum in view of a longitudinal extension of the substantially flat continuous material. Overlap portions in a substantially flat continuous material may not fulfil specifications of the substantially flat continuous material to be used in a product, such as for example a plug in a smoking article. Thus, a rod portion comprising an overlap portion (that is, a connection of the two spliced sheets) may be rejected and removed from further product manufacturing. This may for example be done by providing a rejection device further downstream in the sheet processing line. For example the rejection device may be located after a rod has been formed and is being cut into individual rod-shaped elements. Identification of overlap portions may be done by appropriate detection means, for example optical detection systems. It is for example possible to detect and store a position of an overlap portion in the web in a control unit. This may, for example, be the position where the connection is formed, for example in the pressure unit. A web portion containing the overlap portion that has travelled by a distance from the pressure unit to, for example, a rod cutting position is then removed.

According to an aspect of the method according to the invention, the method further comprises the step of cooling the first substantially flat continuous material and the second substantially flat continuous material during or after performing the combining step.

According to another aspect of the method according to the invention, the method further comprises the steps of providing a gas stream and directing the gas stream into a moving direction of at least the first substantially flat continuous material or of the second substantially flat continuous material. Thereby, at least the first substantially flat continuous material or the second substantially flat continuous material, preferably both, first and second substantially flat continuous material, are guided by the gas stream into the moving direction. A transport gas stream or a gas source used for the transport gas stream may also be used for cooling the substantially flat continuous material or objects the substantially flat continuous material comes into contact with.

Further aspects and advantages of the method have already been described relating to the apparatus according to the invention and will not be repeated.

According to another aspect of the method according to the invention, the method comprises the following further steps before applying the mechanical impact: cutting the first substantially flat continuous material and the second substantially flat continuous material such as to provide the first substantially flat continuous material and the second substantially flat continuous material with edge cuts, preferably substantially complementary edge cuts, and aligning the edge cuts of the first substantially flat continuous material and of the second substantially flat continuous material such that the edge cuts overlap each other. In case of complementary edge cuts, the edge cuts are aligned parallel to each other when overlapping.

The method may comprise the further step of dispensing a liquid, preferably water, to at least the first substantially flat continuous material or the second substantially flat continuous material before overlapping the two materials.

Cutting the substantially flat continuous materials provides a predetermined end portion of a previous substantially flat continuous material and a predetermined head portion of a subsequent substantially flat continuous material that are to be spliced to provide an ongoing continuous substantially flat continuous material. Thus, also the longitudinal extension of an overlap portion, and of a merged portion, where the substantially flat continuous materials are merged, may more precisely be defined. Especially, the longitudinal extension may be limited in size, which may reduce waste if overlap portions are removed.

A mechanical impact may reduce the thickness of the overlap portion or at least of those parts of the overlap portion, where the mechanical impact is applied. A thickness reduction may be in a range of about 10 percent to about 30 percent of the overlap portion. For example, when overlapping two sheets of polylactic acid each having a thickness of about 50 microns, the thickness of the merged portion may be in a range of about 80 microns.

The cutting of the substantially flat continuous materials may be performed in a subsequent manner. The cutting may also be performed simultaneously for both substantially flat continuous materials. The cutting may be performed in the same or in individual cutting units. Preferably, the cutting is performed in separate cutting units such that an overlapping of the two webs is performed after the cutting step and preferably after aligning the two continuous sheets parallel to each other. Thus, depending on the arrangement of the cutting unit or cutting units, the substantially flat continuous materials may be arranged next to each other or may already overlie each other when being cut. When overlapping, preferably, the substantially flat continuous materials are aligned to lie above each other in a centered manner along a longitudinal central axis of the substantially flat continuous materials. The cutting provides edge cuts and clearly defined end and head portions. By this, also an overlap portion may be clearly defined, especially with complementary cuts a regular or symmetric overlap portion may be formed.

Preferably, the cutting is performed at an angle, preferably a cutting angle corresponding to the splicing angle or the angle of the hammer edge, respectively. For this, one or two knives or cutting edges are arranged transverse to the moving direction of the continuous material. Preferably one or two knives or cutting edges are arranged at an angle to the direction perpendicular to the moving direction of the continuous sheet material. Therein, the direction transverse to the moving direction deviates from the direction perpendicular to the moving direction by a cutting angle in a range of between about 10 degree and about 60 degree, preferably between about 15 degree and about 45 degree, for example 40 degree. That is, the cutting edge or edges are not arranged perpendicular to the moving direction but also slightly oblique relative to the exact perpendicular direction.

Adding a liquid, preferably water to at least one of the substantially flat continuous materials may moisten and soften the material of the substantially flat continuous material. While the material of the substantially flat continuous materials, especially tobacco sheets, may have a certain tackiness by itself, such tackiness may be enhanced by adding water. Preferably, a liquid or water is added to one substantially flat continuous material only. By this, the added liquid may support the splicing process of the substantially flat continuous materials in the contact area of the substantially flat continuous materials without excess water that might negatively affect a connection. Preferably, as liquid, a fluid is used that does not affect the aerosol that may be generated in the final product. A liquid other than water suitable for use to support the splicing process may for example be a volatile substance such as alcohol.

Preferably, a cutting location is located upstream of the splicing location. Preferably, a water dispenser for dispensing water to the substantially flat continuous material is arranged at a location of a knife for cutting the first or second substantially flat continuous material.

Preferably, the first substantially flat continuous material and the second substantially flat continuous material are polylactic acid sheets (PLA) or tobacco sheets.

A polylactic acid sheet may have a thickness between about 10 microns and about 250 microns, preferably about 50 microns. A polylactic acid sheet has a low melting temperature in the range of about 80 degree Celsius. Preferably, the melting temperature is reached upon splicing.

A tobacco sheet may contain tobacco leaf, fragments of tobacco ribs, reconstituted tobacco, homogenised tobacco, extruded tobacco, expanded tobacco or any combination thereof. Preferably, a tobacco sheet is cast leaf tobacco. Cast leaf tobacco is a form of reconstituted tobacco that is formed from a slurry including tobacco particles, fiber particles, aerosol formers, flavors, and binders. Tobacco particles may be of the form of a tobacco dust having a particle size preferably in the order between about 30 micron to 80 micron or about 100 micron to 250 micron, depending on the desired sheet thickness and casting gap. Fiber particles may include tobacco stem materials, stalks or other tobacco plant material, and other cellulose-based fibers, such as wood fibers having a low lignin content. Fiber particles may be selected based on the desire to produce a sufficient tensile strength for the cast leaf versus a low inclusion rate, for example, a rate between approximately 2 percent to 15 percent. Alternatively or additionally, fibers, such as vegetable fibers, may be used either with the above fibers or in the alternative, including hemp and bamboo.

Aerosol formers may be added to the slurry that forms the cast leaf tobacco. Functionally, the aerosol former should be capable of vaporizing within the temperature range at which the cast leaf tobacco is intended to be used in the tobacco product, and facilitates conveying nicotine or flavour or both nicotine and flavour, in an aerosol when the aerosol former is heated above its vaporization temperature. The aerosol former is preferably chosen based on its ability to remain chemically stable and essentially stationary in the cast leaf tobacco at or around room temperature, but which is able to vaporize at a higher temperature, for example, between 40 degree to 450 degree Celsius.

As used herein, the term aerosol refers to a colloid comprising solid or liquid particles and a gaseous phase. An aerosol may be a solid aerosol consisting of solid particles and a gaseous phase or a liquid aerosol consisting of liquid particles and a gaseous phase. An aerosol may comprise both solid and liquid particles in a gaseous phase. As used herein both gas and vapour are considered to be gaseous.

The tobacco sheet may have an aerosol former content of between about 5 percent and about 30 percent on a dry weight basis. In a preferred embodiment, the tobacco sheet has an aerosol former content of approximately 20 percent on a dry weight basis.

Preferably, the aerosol former is polar and is capable of functioning as a humectant, which can help maintain moisture within a desirable range in the cast leaf tobacco. Preferably, a humectant content in the cast leaf tobacco is in a range between 15 percent and 35 percent.

Aerosol formers may be selected from the polyols, glycol ethers, polyol ester, esters, fatty acids and monohydric alcohols, such as menthol and may comprise one or more of the following compounds: polyhydric alcohols, such as propylene glycol; glycerin, erythritol, 1,3-butylene glycol, tetraethylene glycol, triethylene glycol, triethyl citrate, propylene carbonate, ethyl laurate, triacetin, meso-erythritol, a diacetin mixture, a diethyl suberate, triethyl citrate, benzyl benzoate, benzyl phenyl acetate, ethyl vanillate, tributyrin, lauryl acetate, lauric acid, myristic acid, and propylene glycol.

One or more aerosol former may be combined to take advantage of one or more properties of the combined aerosol formers. For example, triacetin may be combined with glycerin and water to take advantage of the triacetin's ability to convey active components and the humectant properties of the glycerin.

Tobacco cast leaf or other tobacco sheets are preferably crimped, gathered or folded to then form a rod-shaped segment. The cast leaf material tends to be tacky and be plastically deformable. If pressure is exerted onto such a cast leaf segment, the segment tends to irreversibly deviate from its intended, for example circular, shape.

However, also other sheet materials, such as sheet material selected from the group consisting of polyethylene (PE), polypropylene (PP), polyvinylchloride (PVC), polyethylene terephthalate (PET), cellulose acetate (CA), and aluminium foil or any combination thereof may be spliced with the method according to the invention.

Preferably, a substantially flat continuous material as used in the method according to the invention has a width of between about 150 millimeter and about 250 millimeter.

The invention is further described with regard to embodiments, which are illustrated by means of the following drawings, wherein FIGS. 1-3 show top views of two webs of substantially flat continuous material before and after splicing;

Figure 1:
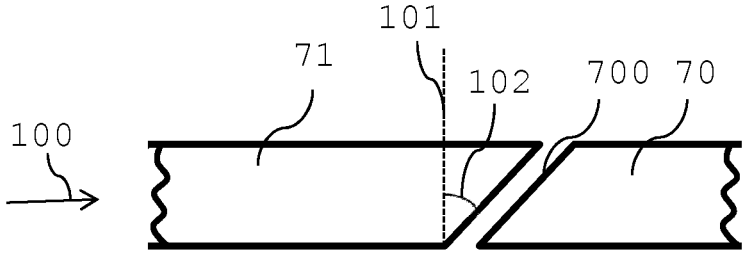
Figure 2:
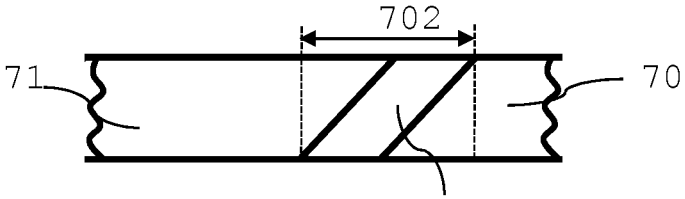
Figure 3:
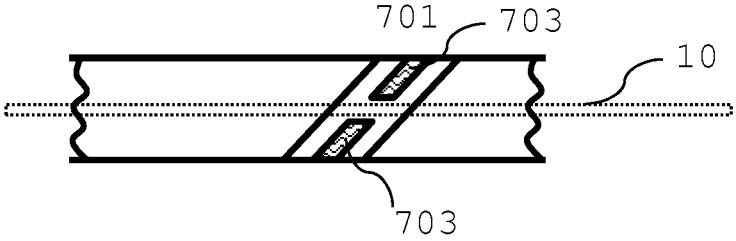

In FIGS. 1 to 3 the splicing process is shown. A first continuous flat material web 70 and a subsequently following second continuous flat material web 71 are transported along the transport direction 100. Both sheet material 70,71 have the same width and are aligned along their longitudinal middle axis. The end portion of the first web and the head portion of the second web have been cut to provide predefined edge cuts 700 having a form complementary to each other. Knifes (not shown) are arranged such that the webs are cut at an angle 102 to the width of the webs or with respect to the direction perpendicular 101 to the transport direction 100. As shown in FIG. 2 the webs 70 71 are then overlapped to form an overlap portion 701. Due to the obliquely cut webs the overlap portion 701 forms a parallelepiped. The angle 102 at which the webs are cut influences the size of the overlap portion. Especially, a longitudinal extension 702 of the overlap portion may be kept small with small cutting angles 102. A cutting angle may be in a range of between about 10 degree and about 60 degree, preferably between about 15 degree and about 45 degree, for example 40 degree. The longitudinal extension 102 of the overlap portion is preferably within a range of 10 millimeter and 100 mm, for example 40 millimeter to 80 millimeter.

In FIG. 3 the two webs have been spliced by partly merging the overlap portion. The connection of the two webs is formed by a merged portion 703 in the form of two parallelepipeds arranged on the two lateral sides of the webs 70,71. The two parts extend to the lateral side edges of the webs but leave a space in between the two parts. It has been shown that a continuous merged portion 703 continuously merging the entire width of the webs is not necessarily required for a reliable splicing. In addition, in the space between the merged parts, a conveyor belt 10, for example a vacuum belt for transporting the webs, is arranged below the webs, which is indicated by dotted lines. The merged portion 703 is produced by applying a mechanical impact onto the webs by two hammers impacting against an anvil, wherein no mechanical impact is applied onto the conveyor belt arranged in between the hammers. The hammers are arranged to extend over the width of the webs, however also at an angle to the direction perpendicular 101 to the transport direction 100. In the embodiments shown, cutting angle 102 and splicing angle are substantially identical. A splicing angle may also differ from a cutting angle and may be in a range of between about 10 degree and about 60 degree, preferably between about 15 degree and about 45 degree, for example 40 degree.

Figure 4:
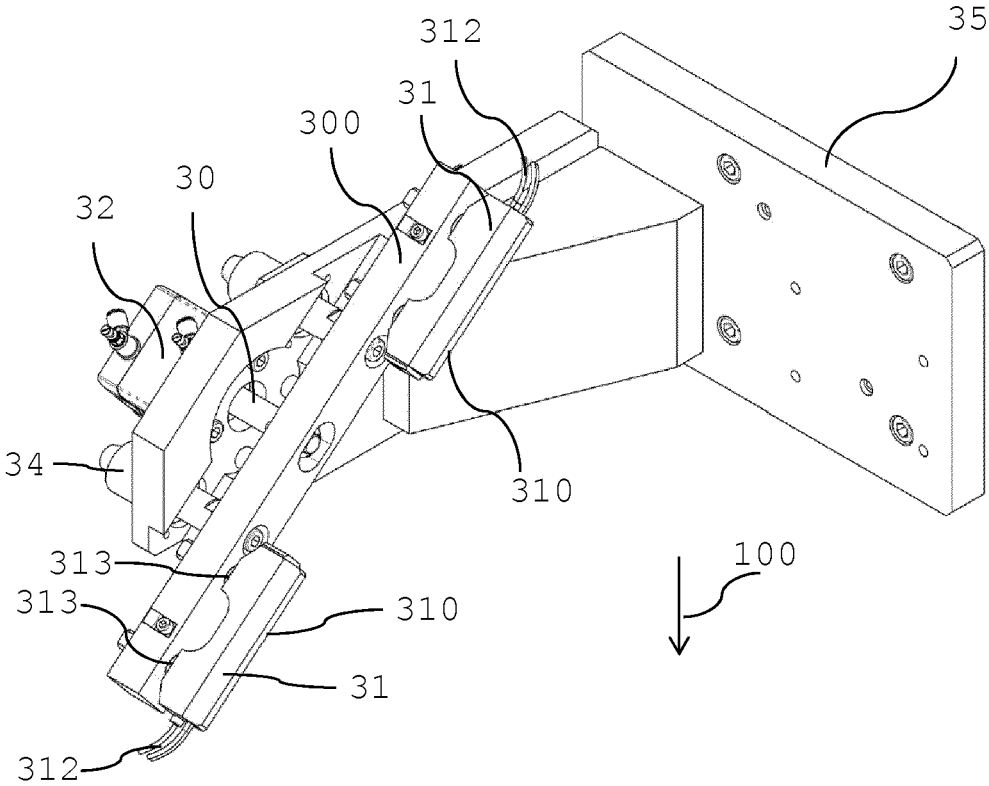
FIG. 4 shows a mechanical pressure unit.

FIG. 4 shows a pressure unit 3 with two hammers 31 and drive means 32, such as, for example, a pressurized air source. The drive means 32 drive a piston 30, which piston drives the hammers. Therefore, the piston comprises an enlarged head portion 300, where the two hammers 31 are mounted to. The hammers 31 each comprise a longitudinal hammer surface 310 for acting upon the flat material to be spliced. The hammers 31 are aligned such that the two hammer surfaces 310 lie on a same imaginary line. The hammers 31 are distance from each other on this imaginary line. The hammers comprise two spring washers 313 each or bellows for damping the hammers. Each hammer is provided with external connections 312 for heating or cooling or heating and cooling the hammers 31. The pressure unit further comprises longitudinal guiding means 24 in mechanical connection with the enlarged head portion 300 of the piston 30. The guiding means 24 guide the piston 30 when in hammering action, that is, when applying a mechanical impact via the hammers 31 onto the web material. They support a balancing of the force distribution onto the hammers 31 and may prevent unintended rotation of the hammers. The pressure unit 34 is mounted to the apparatus via support 35.

The transport direction of webs to be spliced is indicated via arrow 100. The position of the hammers 31 is skew to the transport direction 100 and skew to the direction perpendicular to the transport direction at a splicing angle corresponding to the cutting angle 102. The piston 30 is fixed against rotation, however, preferably, this rotational position may be varied. Thus, the piston 30 may be rotated around its longitudinal axis to change the position of the hammers 31, that is, to change the splicing angle.

Figure 5:
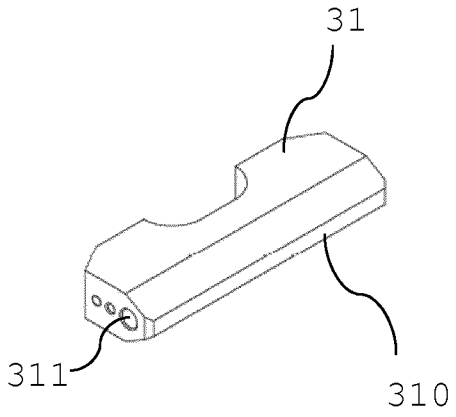
FIG. 5 shows a hammer of the pressure unit of FIG. 4.

In FIG. 5 one of the two hammers 31 of the pressure unit of FIG. 4 is shown. The hammer 31 has a hammer edge 310 with a hammer surface acting upon the web materials to be spliced. The hammer 31 also comprises openings 311 for connecting heating or cooling connections to the hammer. Such heating connections may for example be electrical connections or tube connections for introducing a heating or cooling fluid into or through the interior of the hammer. Exemplary values for the hammer may be: weight 120 grams; size: 105×18×35 millimeters; width of hammer surface 6 millimeters.

Preferably, a substantially flat hammer edge 310 is used for merging the web material. For example, for thin materials having a low melting temperature, that is, having a melting temperature that is reached or exceeded upon a mechanical impact, a flat profile may preferably be used for splicing. The melting of the material may suffice to create a strong merging portion. Thus, the flat hammer surface guarantees the formation of a reliable connection between the two webs without the risk of creating holes or thin spots that tend to weaken the material in the merged portion 703.

However, depending on the web material to be spliced, for example a thicker material, for example thicker than 200 microns per web, also a structured hammer surface may be used. A structured hammer surface may, for example, comprise a three-dimensional serrated profile or be a grid structure of pyramid-shaped protrusions. A structure may support the merging of the material of one web into the material of the second web.

Figure 6:
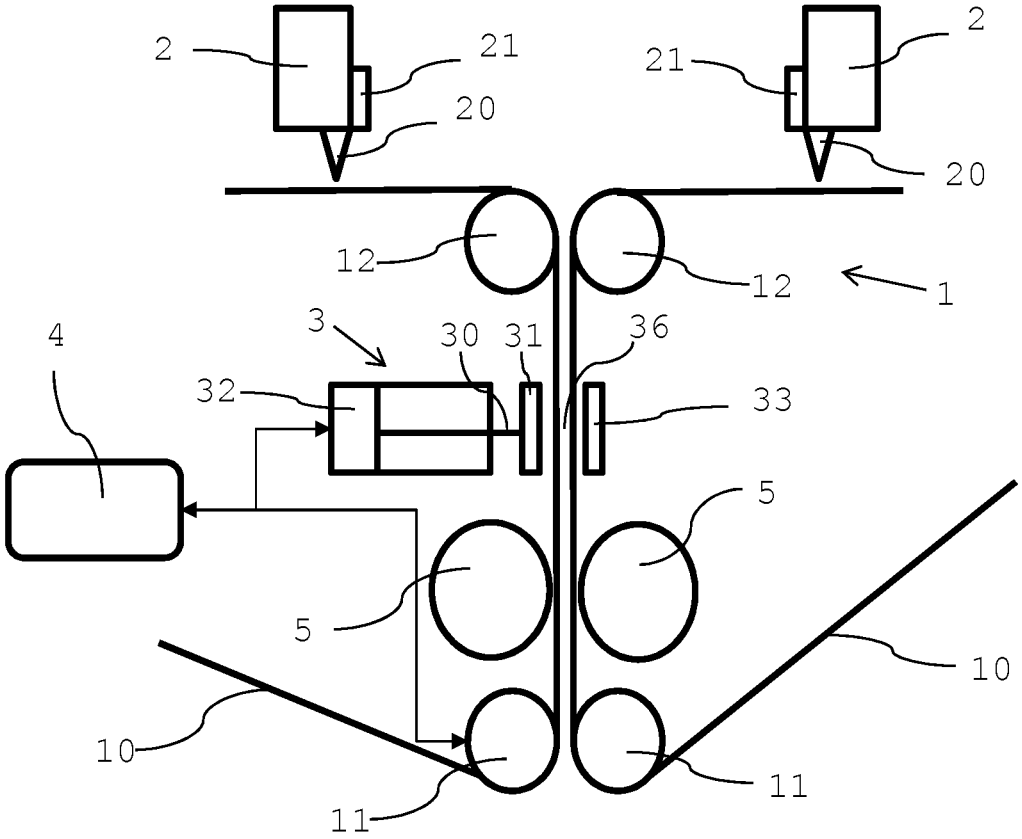
FIG. 6 shows an apparatus according to the invention.

FIG. 6 shows the transport unit 1 comprising two transport belts 10, each for transporting a substantially flat continuous material, such as a for example webs of paper or plastic, metal foil or tobacco webs. The transport belts pass below a cutting unit 2, are then guided via deflection rollers 12 to be led parallel to each other through the pressure unit 3 and through embossing rollers 5 arranged downstream of the pressure unit 3. Over drive rollers 11, the conveyor belts may be guided again via the deflection rollers 12, thereby forming continuous belt loops.

The cutting units 2 each comprise a knife holder holding a knife 20 for cutting a continuous web transported on the conveyor belt below the cutting unit 12. The cutting units 2 are also provided with a water dispenser 21 each for supplying water to the webs in the cut area or onto a web portion being part of a future overlap portion 701 for example as shown and described above relating to FIGS. 1 to 3. The water dispenser may for example comprise a nozzle. Preferably, water is dispensed or sprayed onto one web only, preferably a future lower lying web such that one water dispenser may be optional or only one water dispenser may be active at a time.

The pressure unit 3 comprises an actuator 32 for actuating a piston 30 comprising one or several hammers 31 arranged at the distal end of the piston. An anvil 33 is arranged opposite the piston 30 and hammer 31. The webs transported via the transport belts 10 are guided in parallel through the splicing location 36 located between hammer 31 and anvil 33. In the splicing location 36 the webs are arranged having an overlap portion required for reliably splicing the webs. The pressure unit 3 is then actuated to apply a mechanical impulse such as a blow from the hammer 31 against the anvil 33, where the overlap portion is arranged between hammer and anvil. By this, the two webs are merged together and may further downstream be provided with a structure, for example an embossing structure, crimping structure or folding structure, while passing between the embossing rollers 5. As shown in FIG. 6 the webs are transported vertically downwards into and through the pressure unit 3. The transporting and overlapping of the webs is thereby supported by gravitational force. The merged and embossed continuous web is further transported vertically out of the apparatus while belts 10 are guided by the drive rollers 11 back to supply a further web material to be spliced to an upcoming end of the web material actually in use.

A control unit 4 is provided to control and actuate the pressure unit 3 and the drive rollers 11. Preferably, the webs are stationary while being spliced. Thus, via the control unit 4 the drive rollers 11 may slow down or stop the conveyor belts 10 for the splicing process. After the splicing process at least one of the conveyor belts 10 is started to continue the transport of the now spliced web. Preferably, this is done by slowly raising the velocity of the belt or belts until a final velocity is reached.

An exemplary embodiment of a splicing set-up is:

Material: two polylactic acid webs with a thickness of 50 microns plus or minus 5 microns; the obliquely cut webs, cut at a cutting angle of 40 degree, are made to overlap with a longitudinal extension of the overlap portion of about 80 millimeter;

Pressure unit: 2.4 bar air pressure is applied to piston having a cross section of 50 millimeter and 20 square centimeter piston surface; two hammers 31 with a hammer edge surface of about 6 square centimeter each are heated to about 100 degree Celsius; a mechanical impulse with a force of 450 Newton and of 350 millisecond duration is applied to the overlapping PLA webs.

While the embodiments as shown in the drawings comprise two hammers, variations of this set-up may be envisages without departing from the scope of the invention. For example, one or three hammers may be provided, while one, two or more conveyor belts are guided outside of a merging zone. For example, the conveyor belts may be laterally displaced in view of an outside of the position of the hammer(s), as well as may be arranged in between neighbouring hammers.

The invention claimed is:

1. Apparatus for splicing substantially flat continuous material, the apparatus comprising:

a transport unit for transporting a first substantially flat continuous material and a second substantially flat continuous material to a splicing location, wherein the transport unit is adapted to transport the first substantially flat continuous material and the second substantially flat continuous material parallel to each other forming an overlap portion of the first substantially flat continuous material and the second substantially flat continuous material in the splicing location;

a pressure unit arranged in the splicing location adapted to apply a mechanical impact of a duration between 100 milliseconds and 500 milliseconds and with a force in a range between 100 Newtons and 600 Newtons onto at least a part of the overlap portion of the first substantially flat continuous material and the second substantially flat continuous material, thereby at least partially merging the first substantially flat continuous material with the second substantially flat continuous material, wherein the transport unit comprises a belt conveyor, wherein the belt conveyor is guided to and through the pressure unit and transports at least the first substantially flat continuous material into, through, and past the pressure unit and further in a processing line, wherein the belt conveyor does not contact the part the pressure unit is adapted to apply a mechanical impact to, and wherein in the splicing location the belt conveyor only contacts a portion of the overlap portion such that the belt conveyor does not directly receive the mechanical impact.

2. Apparatus according to claim 1, further comprising a transport control for interrupting a transport of the first substantially flat continuous material and of the second substantially flat continuous material when the overlap portion is in the splicing location and for continuing a transport of the first substantially flat continuous material and second substantially flat continuous material, when a merged substantially flat continuous material has been produced.

3. Apparatus according to claim 1, wherein the pressure unit comprises a hammer edge arranged transverse to a moving direction of the transport unit, wherein the direction transverse to the moving direction deviates from a direction perpendicular to the moving direction by a splicing angle in a range between 10 degree and 60 degree.

4. Apparatus according to claim 1, wherein the transport unit comprises a transport support unit adapted to providing a gas stream.

5. Apparatus according to claim 1, further comprising a buffer for storing substantially flat continuous material, the buffer being arranged downstream of the splicing location.

6. Apparatus according to claim 1, comprising embossing rollers for embossing substantially flat continuous material.

7. Apparatus according to claim 1, comprising a heating unit adapted to heat at least a portion of the pressure unit.

8. Apparatus according to claim 1, wherein no additional material is provided to the first and second substantially flat continuous material for the at least partially merging the first substantially flat continuous material with the second substantially flat continuous material.

9. Apparatus according to claim 1, wherein the at least partially merging the first substantially flat continuous material with the second substantially flat continuous material creates a form fit or a chemical connection between the two materials.

10. Apparatus according to claim 1, wherein a thickness of the at least partially merged first substantially flat continuous material with the second substantially flat continuous material is reduced in a range of 10 percent compared to a thickness of the overlap portion of the first substantially flat continuous material and the second substantially flat continuous material.

11. Apparatus according to claim 1, wherein the pressure unit comprises at least a hammer edge, and wherein the conveyor belt is laterally displaced from the hammer edge such as to be outside of a merging zone.

12. Apparatus according to claim 11, wherein the conveyor belt is arranged in between two hammer edges.

13. Apparatus according to claim 1, further comprising a first cutting unit adapted to cut the first substantially flat continuous material and a second cutting unit adapted to cut the second substantially flat continuous material such as to provide the first substantially flat continuous material and the second substantially flat continuous material with complementary edge cuts, wherein the first and the second cutting units are arranged upstream of the pressure unit.

14. Apparatus according to claim 13, wherein the first and second cutting units comprise cutting edges arranged at an angle relative to the exact perpendicular direction of the first and second substantially flat continuous material, wherein the perpendicular direction is perpendicular to the moving direction of the first and second substantially flat continuous material.

* * * * *